US006915667B2

(12) United States Patent
Morita et al.

(10) Patent No.: US 6,915,667 B2
(45) Date of Patent: Jul. 12, 2005

(54) COMPOSITE NEEDLE OF KNITTING MACHINE

(75) Inventors: Toshiaki Morita, Wakayama (JP); Toshinori Nakamori, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/487,490

(22) PCT Filed: Aug. 22, 2002

(86) PCT No.: PCT/JP02/08497

§ 371 (c)(1),
(2), (4) Date: Feb. 23, 2004

(87) PCT Pub. No.: WO03/018893

PCT Pub. Date: Mar. 6, 2003

(65) Prior Publication Data

US 2004/0237596 A1 Dec. 2, 2004

(30) Foreign Application Priority Data

Aug. 24, 2001 (JP) ..... 2001-254915

(51) Int. Cl.[7] ..... D04B 35/06
(52) U.S. Cl. ..... 66/120
(58) Field of Search ..... 66/116, 120, 123, 66/124

(56) References Cited

U.S. PATENT DOCUMENTS 4,043,153 A * 8/1977 Lindner et al. ..... 66/120
4,584,852 A 4/1986 Beck et al.
6,339,942 B1 * 1/2002 Majer et al. ..... 66/120
6,510,713 B1 * 1/2003 Shima ..... 66/120
6,568,223 B1 * 5/2003 Morita ..... 66/120

FOREIGN PATENT DOCUMENTS

| | | |
|---|---|---|
| JP | 1-52497 | 11/1989 |
| JP | 5-78962 | 3/1993 |
| JP | 2946323 | 7/1999 |
| JP | 2001-32154 | 2/2001 |
| JP | 2001-140148 | 5/2001 |

* cited by examiner

*Primary Examiner*—Danny Worrell
(74) *Attorney, Agent, or Firm*—Wenderoth, Lind & Ponack, L.L.P.

(57) ABSTRACT

A composite needle of a knitting machine, comprises: a needle body having at a tip end a hook; a slider formed by superposing two blades, wherein the composite needle of the knitting machine is formed such that a blade groove provided in the needle body supports the blades of the slider when the needle body and the slider can separately slide in forward and backward directions; and a dust-collecting plate that is seperately formed from the needle body and that extends, when viewed from a side, from the blade groove of the needle body in an upward direction and to a hook side of the needle such that the dust-collecting plate is provided at a tip end of the slider proximate to the hook.

4 Claims, 7 Drawing Sheets

COMPOSITE NEEDLE OF KNITTING MACHINE

TECHNICAL FIELD

The present invention relates to a knitting needle used in a knitting machine. In particular, the present invention relates to a composite needle that has a needle body having at a tip end a hook, and that has at the tip end tongues structured to have relative displacement with respect to a needle body section. The tongues work in cooperation with the hook to close and open the hook so that dust adhered to and accumulated in the composite needle can be removed.

BACKGROUND ART

Japanese Patent Publication No. 2946323 proposed by the present applicant discloses a known needle body having a tip end a hook and a slider, in which the needle body and slider have relative displacement to allow the hook to be closed and opened.

This composite needle has a slider formed by superimposing two blades. The blades have a thickness that is thinner than a groove width of a blade storage groove provided in the needle body. This provides a gap between the blades and the groove so that the blades are supported so as to freely advance and recede in the groove.

In a knitting machine having a composite needle of such a structure, the two blades at a slider tip end make contact with a side face part of a hook tip end of the needle body to advance so that the blades are branched left and right. The two blades advancing beyond the hook have therebetween a space into which a knitting needle of an opposing needle bed is allowed to enter, thereby performing a transferring stitch.

The above-described structure in which the slider advances to allow the two blades to be branched left and right tends to cause the two blades to have therebetween adhesion and accumulation of dust such as lint particles. Such adhesion and accumulation of dust between the two blades causes the slider to have an increased sliding resistance or causes the blade to become deformed.

Such an increased sliding resistance of the slider or deformation of the blade causes the needle to malfunction, thus preventing an accurate knitting operation. Such an increased sliding resistance of the slider or deformation of the blade also causes a fear in which a control butt of a needle and a cam for driving the needle cause abrasion and breakage or burn out.

Such problems cause additional problems such as reduced productivity or reduced quality of a knit.

The present invention has been proposed in view of the above-described problems. It is an object of the present invention to provide a composite needle that can prevent dust or the like from being adhered to and accumulated between the blades to prevent the problems as described above from occurring.

SUMMARY OF THE INVENTION

In order to solve the above-described problems, the composite needle according to the present invention is characterized by comprising: a needle body having at a tip end a hook; a slider formed by superposing two blades, wherein the composite needle of the knitting machine is formed such that a blade groove provided in the needle body supports the blades of the slider where the needle body and the slider can seperately slide in forward and backward directions; and a dust-collecting plate that is seperately formed from the needle body and that extends, when viewed from the side, from the blade groove of the needle body in an upward direction and to a hook side of the needle, such that the dust-collecting plate is provided in the blade groove and stands between the two blades.

The composite needle is characterized in that it has a hole penetrating a side wall of the blade groove and a bottom face of the blade groove, and the hole is fixed when the hole is attached with a projection provided at a lower part of the dust-collecting plate. The composite needle is also characterized in that the dust-collecting plate is provided at a position at which a part is at least superposed between an area at which the needle hook removes dust when the slider advances with reference to the needle body and an area at which the needle hook removes dust when the slider recedes from the needle body.

DETAILED DESCRIPTION OF THE PREFERRED EMBODIMENTS

Embodiments of the present invention are described with reference to the drawings.

Figure 1:
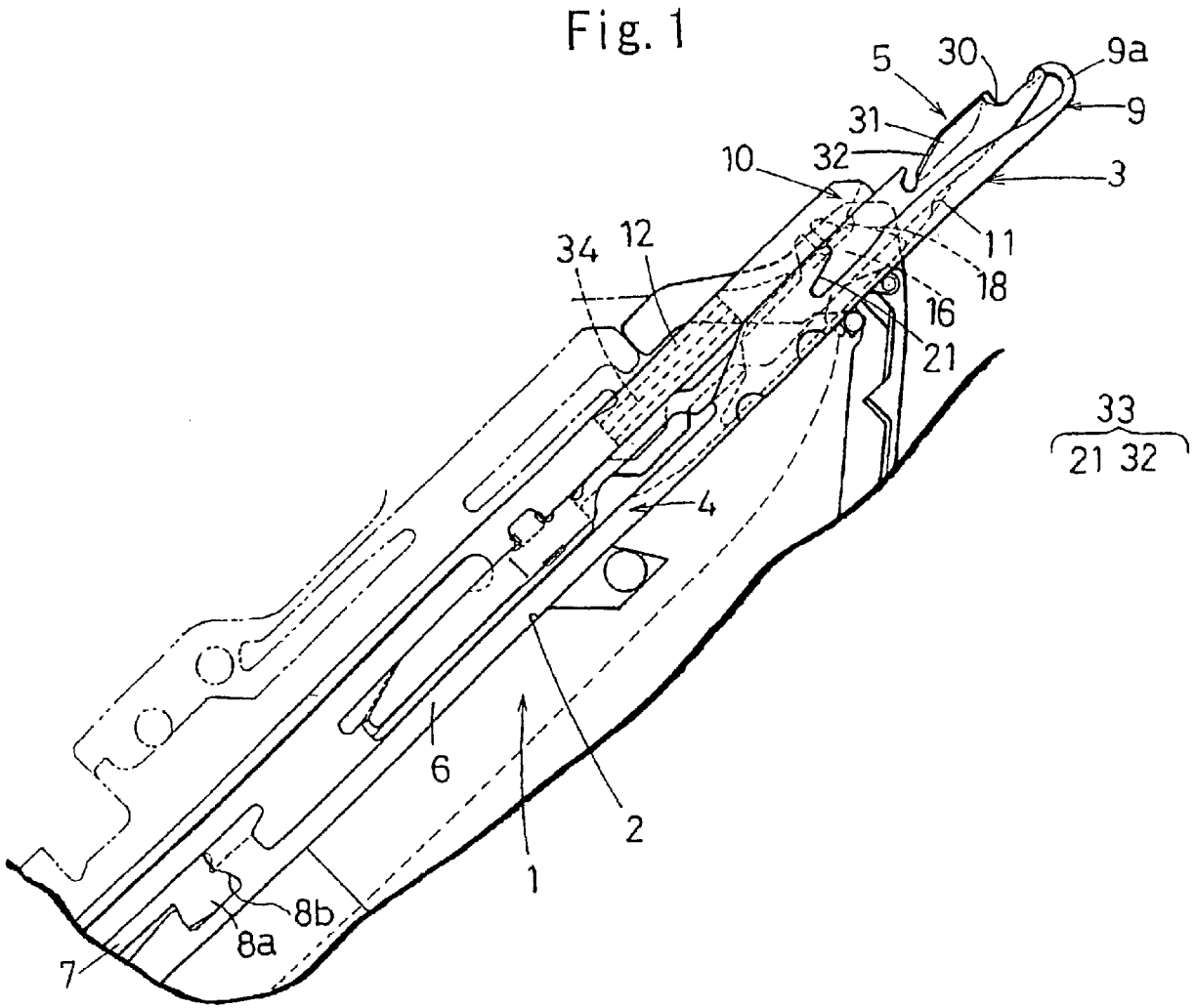
FIG. 1 illustrates a composite needle of the present invention in which a head part of the composite needle is attached to a needle groove provided in a needle bed.

FIG. 1 illustrates a head part of a composite needle 3 attached to a needle groove 2 provided in a needle bed of a flat knitting machine.

Figure 2:
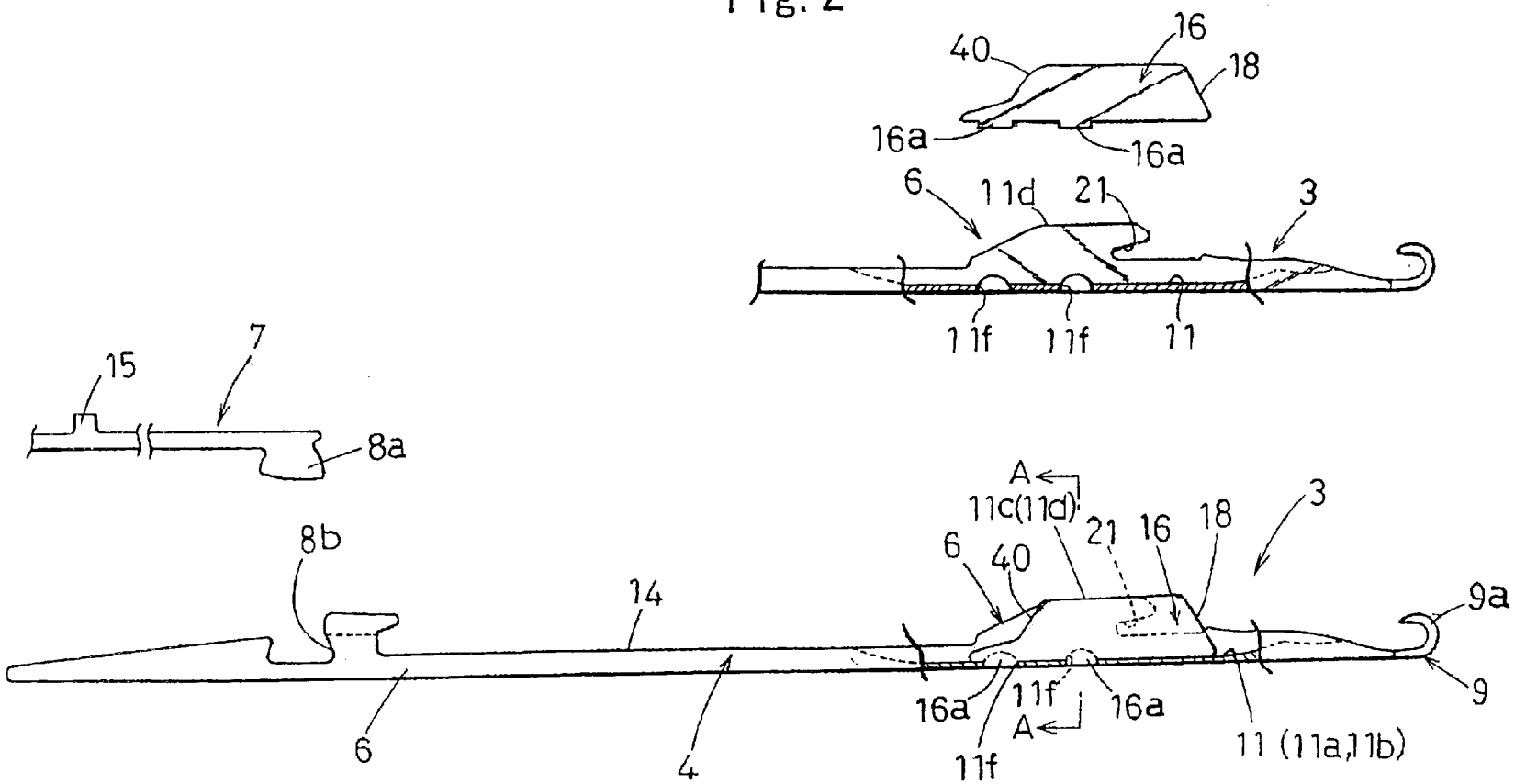
FIG. 2 is a cutaway partial side view of a needle body part of the composite needle of FIG. 1.
Figure 3:
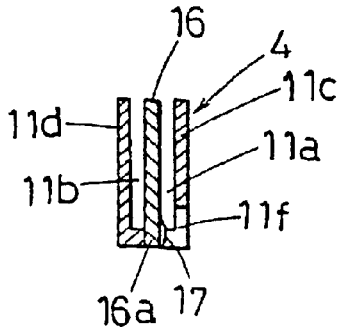
FIG. 3 is a cross-sectional view taken along line A—A shown in FIG. 2.
Figure 4:
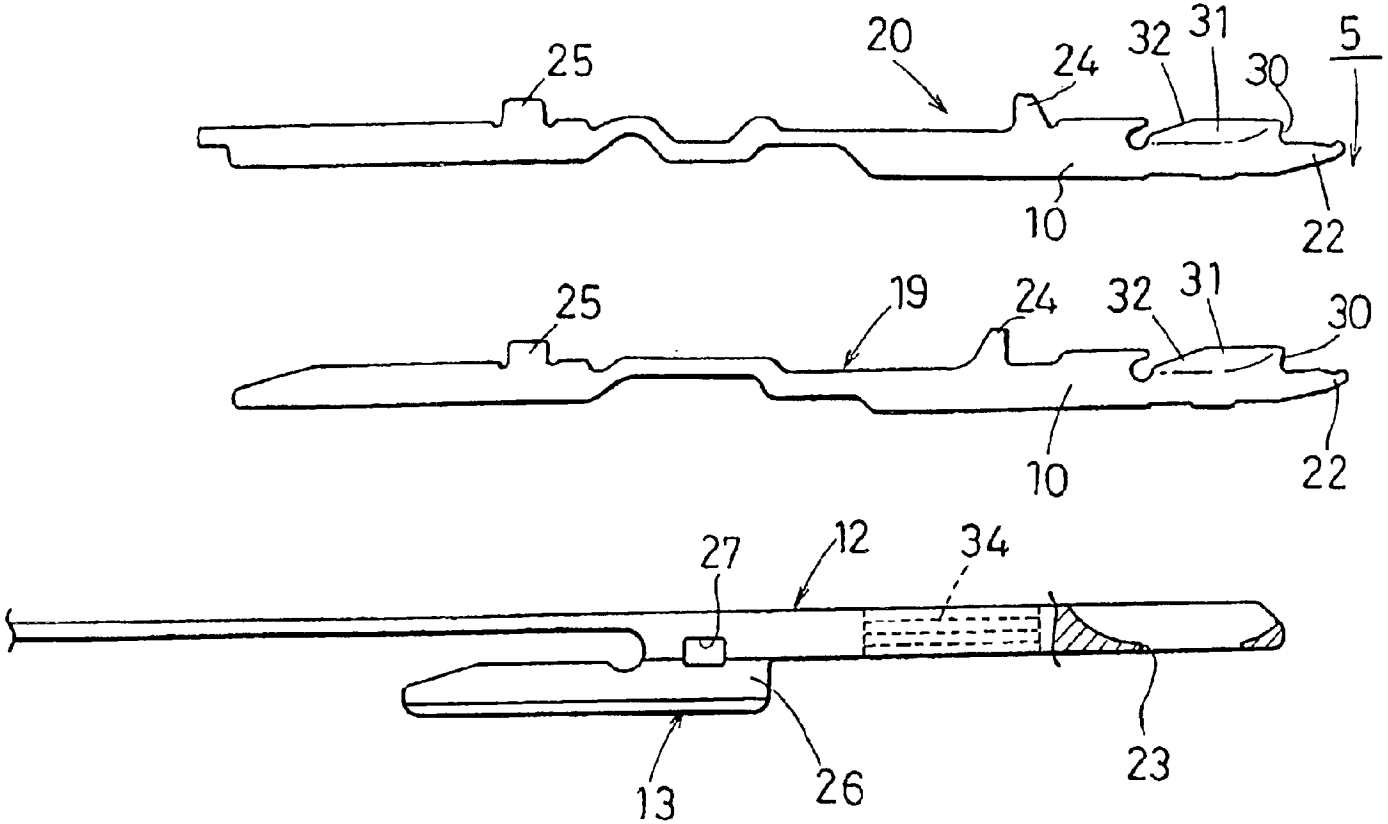
FIG. 4 is a cutaway partial side view illustrating structure of a slider part of the composite needle of the present invention.

FIG. 2 is a cutaway partial side view of a needle body 4. FIG. 3 is a cross-sectional view taken along line A—A shown in FIG. 2. FIG. 4 is a side view illustrating details of parts composing a slider 5.

The composite needle 3 is composed of the needle body 4 and the slider 5. The needle body 4 consists of a hook member 6 and a jack 7 having a separate body. The hook member 6 and the jack 7 may be provided in an integrated manner, but the hook member 6 and the jack 7 in the present embodiment are integrated by engagement of an engagement section 8*a* and an engagement concave section 8*b*.

The hook member 6 includes, from a tip end side, a hook section 9; a body center section 14 for supporting a blade groove 11 for storing a blade section 10 of the slider 5 (described later) and a lower arm section 13 of a slider body section 12; and the above-described engagement concave section 8*b*, a rear end part of which is connected with the engagement section 8*a* at a tip end of the jack 7.

The hook member 6 and the jack 7 have an identical thickness that is slightly thinner than a width of the needle groove 2. The jack 7 has a curved elastic leg section which extends from the above-described engagement concave section 8*b* in a rearward direction, and in which a rear end makes contact with a bottom of the needle groove 2. The jack 7 has at a body center a control butt 15 that is provided in a protruded manner. This control butt 15 is operated to advance and recede while being engaged with a cam provided in a cam carriage (not shown), thereby operating the needle body 4 to slide back and forth.

Figure 5:
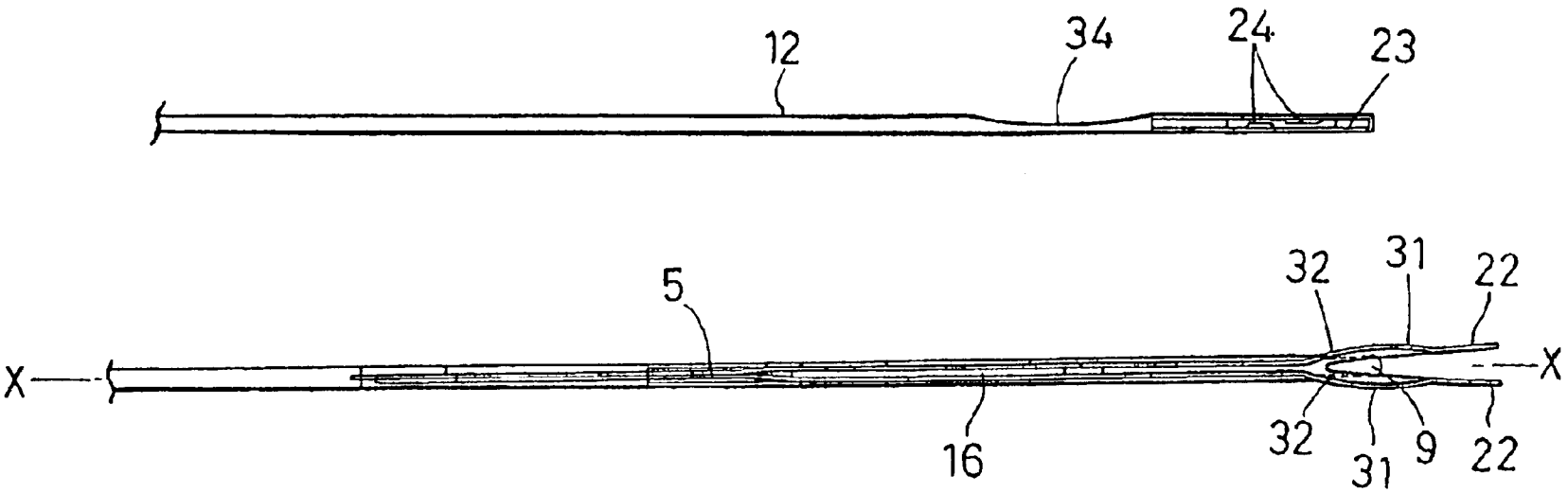
FIG. 5 is a plan view of the slider part of the composite needle of the present invention.

The hook member 6 has the blade groove 11, a tip end of which has a dust-collecting plate 16 along chain line X—X that passes through a tip end of the hook section 9 running in a direction of length of the needle 3 and from a bottom face of the blade groove 11 in an upper direction vertically, as shown in FIG. 5.

The dust-collecting plate 16 has a plate-like shape that has a thickness thinner than that of the hook section 9. This dust-collecting plate 16 is provided at a position as described later by fixing structure such as caulking 17 at which the blade groove 11 is divided into "11*a*" and "11*b*" left and right.

This dust-collecting plate 16 has at a front end an inclined plane that is lowered toward a tip end side. This inclined plane functions as dust removal face 18. The dust-collecting plate 16 has substantially the same height as that of side wall parts 11*c* and 11*d* of the blade groove 11 to which the dust-collecting plate 16 is attached.

This height is substantially equal to or greater than that of blades 19 and 20 that slide while making contact with the dust-collecting plate 16 (see FIG. 2 and FIG. 3).

Figure 6:
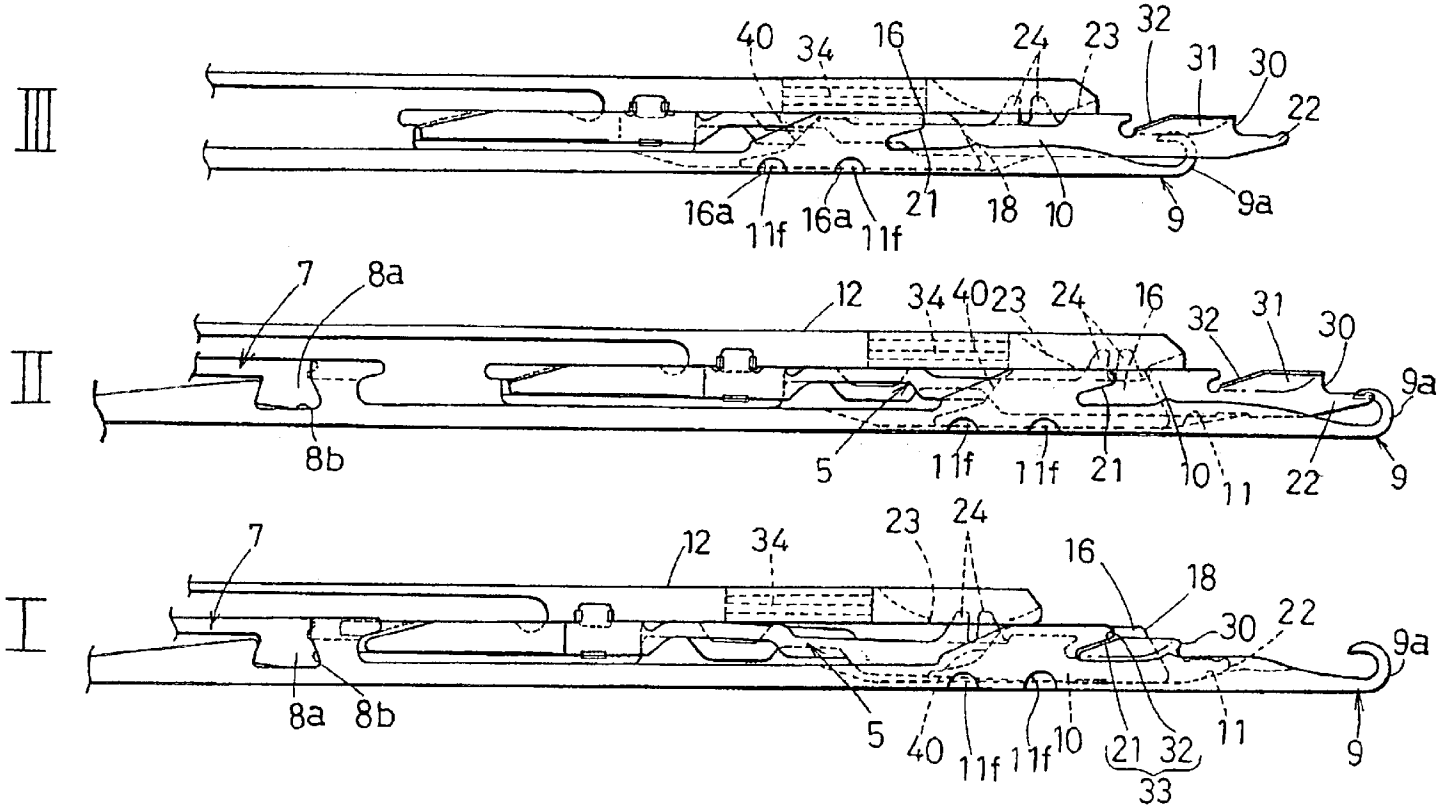
FIG. 6 illustrates operation of the composite needle of the present invention.

Also, the dust-collecting plate 16 is attached at a position at which a part is superposed between an area at which the needle hook removes dust when the slider 5 has maximum advancement with reference to the needle body 4 (FIG. 6-III), and an area of the dust removal face 18 at which the slider 5 has maximum receding with reference to the needle body 4 as shown in FIG. 6-I.

The dust-collecting plate 16 is attached to the blade groove 11 such that the dust-collecting plate 16 has at a lower part a fitting projection 16*a*; hole 11*f* is provided that communicates the side wall parts 11*c* and 11*d* of the blade groove 11 with a bottom face 11*e* of the blade groove 11; this hole 11*f* is fitted with fitting projection 16*a* to provide the dust-collecting plate 16 having at a lower part the projection 16*a* that is fixed by caulking 17 (see FIG. 2 and FIG. 3).

Figure 7:
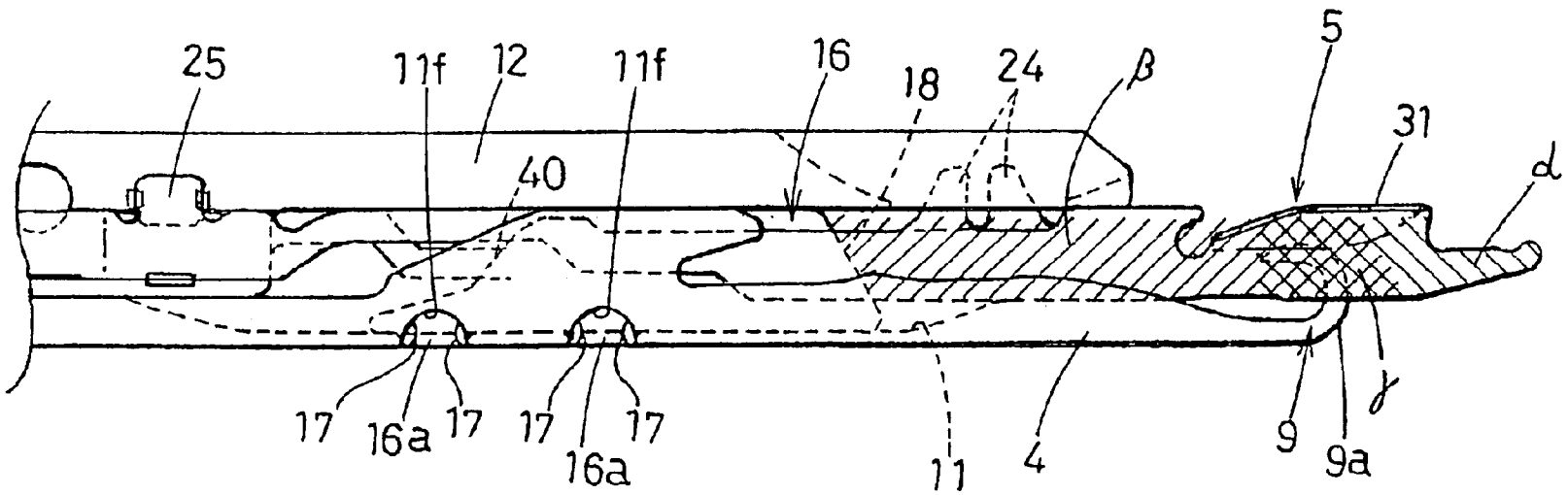
FIG. 7 illustrates operation of dust removal for the composite needle of the present invention.

In this manner, the dust-collecting plate 16 thus attached to the blade groove 11 removes dust. When the hook section 9 moves forward from a position at which the slider 5 recedes from the needle body 4 as shown in FIG. 6-I to a position at which the slider 5 makes maximum advancement with reference to the needle body 4 as shown in FIG. 6-III, then dust in range $\alpha$ of the blades 19 and 20 shown by downwardly-sloping diagonal lines in FIG. 7 is removed. When the slider 5 advances from a position at which the slider 5 is at the needle body 4 as shown in FIG. 6-III to a position at which the slider 5 makes maximum advancement with reference to the needle body 4 as shown in FIG. 6-I, then dust in range $\beta$ of the blades 19 and 20 as shown by the upwardly-sloping diagonal lines in FIG. 7 is removed by the dust removal face 18. A rear side part of range $\alpha$ and a front side part of range $\beta$ are superposed at partial range $\gamma$, thus no dust remains.

In the drawings, reference numeral 40 denotes a rear part dust removal face provided at a rear end part of the dust-collecting plate 16. This rear dust removal face 40 removes dust from a rear part of the blades 19 and 20.

The blade groove 11 has side wall parts 11*c* and 11*d*, front ends of which have inclined guide face 21 for guiding the blades 19 and 20 of the slider 5 (which will be described later) in a downward direction (see FIG. 2).

As shown in FIG. 4, the slider 5 consists of blades 19 and 20 and the slider body section 12 having a separate member.

The blades 19 and 20 are provided by superimposing two plates having substantially the same shape, and are attached to the blade grooves 11*a* and 11*b* that are divided left and right by the above-described dust-collecting plate 16 so that the blades 19 and 20 are stored to sandwich the dust-collecting plate 16.

The blades 19 and 20 have at a tip end side tongues 22 and 22 making contact with the hook tip end part 9*a*. The tongues 22 and 22 have, in a rearward direction, an engagement section 24 of an angular projection that penetrates the tip end part of the slider body section 12 and that is attached to circular opening 23 when viewed from a side. The blade groove 11 has in a rearward direction connection sections 25 and 25 for providing connection with the slider body section 12.

When the knitting machine is cleaned, air is blown to the opening 23 to remove dust collected between the blades 19 and 20.

The slider body section 12 also has half-cut section 34. When the slider body section 12 and the needle body 4 have relative reciprocating motion, the dust removal face 18 of the dust-collecting plate 16 discharges dust collected, in a tail part of the needle body 4, from the needle groove 2 via a space that is provided in the needle plate 1 in the vicinity of the half-cut section 34 and the knitting needle.

The tongues 22 and 22 of the blades 19 and 20 have a rear anchor section in which a vertical yarn receiving section 30 is provided. This yarn receiving section 30 has in the rearward direction a curved section 31 opened to an exterior.

A latter half part of this curved section 31 forms an inclined plane 32 for pushing down the blades 19 and 20 by the inclined guide face 21 provided at the hook member 6. This inclined plane 32 and inclined guide face 21 provide lowering structure 33 for lowering a slider tip end part into the blade groove 11 of the needle body 4.

The slider body section 12 has an identical thickness as that of the needle body 4, and has in the rearward direction a control butt (not shown) provided in a protruded manner for controlling forward and backward movements. The slider body section 12 has in a lower direction a lower arm section 13*a* that is branched from the body section. This lower arm section 13 has at one side face a longitudinal groove 26 that is cut to have a small thickness and that is attached to latter parts of the blades 19 and 20.

This longitudinal groove 26 has a penetrating hole 27. The hole 27 is connected with projections 28 and 28, provided in a protruded manner in the blades 19 and 20 stored in the longitudinal groove 26 by performing a method such as caulking or welding. This allows the blades 19 and 20 to be fixed with the slider body section 12.

The dust-collecting plate 16 has a shape having a height greater than that of the blade groove 11, that has a reduced height, so as to correspond to the curved section 31 provided in the blade. The dust-collecting plate 16 also has a shape that allows wiping away even dust collected in the curved section 31 that is more distant from the lowering structure 33 provided in the needle body 4, and that is closer to the hook section 9 of the needle body 4. When viewed from the side, the dust-collecting plate has a shape that protrudes from the needle body 4 in an upward direction and to a hook side.

Operation performed by the composite needle 3 structured as described above to remove dust based on performance of a transferring stitch operation shown in FIG. 6 will now be described.

As shown in FIG. 6-I, when the slider 5 recedes from the needle body 4, the blades 19 and 20 are respectively stored in the blade grooves 11*a* and 11*b* that are branched left and right by the dust-collecting plate 16. When the needle body 4 protrudes in the forward direction, knitting yarn of a loop to be subjected to a transferring stitch (not shown) remains in the vertical yarn receiving section 30 provided in the rear anchor section of the tongues 22 and 21 of the blades 19 and 20.

Next, as shown in FIG. 6-II, when the slider 5, receiving knitting yarn of a loop to be subjected to a transferring stitch from the yarn receiving section 30, advances toward the needle body 4, the tongues 22 close the hook section 9 and the tongues 22 of the blades 19 and 20 make contact with the tip end of the hook section 9 of the needle body 4, thus allowing the tongues 22 to be gradually opened along a side face of this hook tip end.

When the slider 5 further advances beyond the hook section 9 as shown in FIG. 6-III, the tongues 22 of the blades 19 and 20 are widely opened along the side face of the tip end of the hook section 9 of the needle body 4, as shown in FIG. 5.

The tongues 22 thus widely opened receive an opposing knitting needle to allow the hook (not shown) to enter the tongues 22. Then, the hook receives knitting yarn of a loop received by the yarn receiving section 30 that is to be subjected to a transferring stitch.

Then, the slider 5 recedes so as to open the hook section 9.

Then, dust such as lint particles adhered to the widely-opened tongues 22 is wiped by the dust removal face 18 provided at the front end of the dust-collecting plate 16. Thereafter, the dust is discharged from the needle body 4 when the lowering structure 33 lowers the slider 5 into the blade groove 11 as shown in FIG. 6-I, for example.

According to the composite needle of the knitting machine of the present embodiment as shown in the above-described embodiment, the dust-collecting plate is separately formed from the needle body. This allows the dust-removing plate to easily have a shape that is difficult to be structured such as a reduced gauge knitting needle, by cutting the needle body.

When the dust-collecting plate is provided with a material different from that of the needle body, the dust-collecting plate can be processed in an easy manner. When the dust-collecting plate is separately formed from the needle body, the dust-collecting plate can be freely designed regardless of shape, material, hardness, and processing of the needle body as well as the needle bed in the rearward direction, thus providing a dust-collecting plate having a superior function.

Furthermore, the above-described embodiment is structured with a hook side tail side of the needle of the dust-collecting plate having an inclined shape, respectively. However, the hook side and the tail side of the needle do not necessarily require an inclined shape. However, such an inclined shape is preferable because dust is lifted from a deeper part of the slider groove to provide an improved effect of discharging dust.

According to the composite needle of the knitting machine of the present embodiment, even a knitting needle having a shallower groove of blades can, regardless of shape of the needle body, wipe away dust collected in a part close to the needle hook by a dust-collecting plate that is higher than the blade groove. In this way, the composite needle of the knitting machine of the present embodiment allows a shape of the dust-collecting plate not to be limited by the shape of the needle body, thereby providing a dust-collecting plate having an improved effect of removing dust.

Industrial Applicability

According to the composite needle of the knitting machine of the present embodiment as described above, the composite needle comprises a needle body having at the tip end a hook; a slider formed by superposing two blades, wherein the composite needle of the knitting machine is formed such that a blade groove provided in the needle body supports the blades of the slider where the needle body and slider can separately slide in the forward and backward directions; and a dust-collecting plate that is separately formed from the needle body and that extends, when viewed from the side, from the blade groove of the needle body in an upward direction and a hook side of the needle, such that the dust-collecting plate is provided at the tip end of the slider proximate to the needle hook. This allows dust or the like adhered to the blades, when the slider slides, to be wiped away by the inclined dust removal face of the dust-collecting plate.

This provides an advantage in that adhesion and accumulation of dust or the like are eliminated; the slider is prevented from having an increased sliding resistance and the blade is prevented from being deformed; and the needle is prevented from malfunctioning, thereby providing for an accurate knitting operation.

Furthermore, the above eliminated adhesion and accumulation of dust or the like also prevents the control butt of the needle and the cam for driving the needle from causing abrasion and breakage or burn out. Such prevention of abrasion and breakage, or seizure, of the control butt of the needle and the cam for driving the needle due to adhesion and accumulation of dust or the like also provides an advantage in that productivity is improved and reduced quality of a knit can be prevented.

What is claimed is:

1. A composite needle of a knitting machine, comprising:

a needle body having at a tip end a hook; and a slider formed by superposing two blades, wherein a blade groove provided in said needle body supports said two blades when said needle body and said slider can separately slide in forward and backward directions, and said needle body is fixed with a dust-collecting plate that is formed separately of said needle body and that extends, when viewed from a side, from said blade groove in an upward direction and to a hook side of said needle body such that said dust-collecting plate is provided in said blade groove and stands between said two blades.

2. The composite needle of a knitting machine according to claim 1, further comprising:

a hole communicating a side wall of said blade groove with a bottom face of said blade groove, wherein said the hole is fixed when said hole is attached to a projection provided at a lower part of said dust-collecting plate.

3. The composite needle of a knitting machine according to claim 2, wherein said dust-collecting plate is provided at a position at which at least a part thereof is superposed between an area at which said hook removes dust when said slider advances with reference to said needle body and an area at which said hook removes dust when said slider recedes from said needle body.

4. The composite needle of a knitting machine according to claim 1, wherein said dust-collecting plate is provided at a position at which at least a part thereof is superposed between an area at which said hook removes dust when said slider advances with reference to said needle body and an area at which said hook removes dust when said slider recedes from said needle body.

* * * * *